US006907814B2

(12) United States Patent
Spinner et al.

(10) Patent No.: US 6,907,814 B2
(45) Date of Patent: Jun. 21, 2005

(54) AUTOMATIC FIREARMS WITH A DETACHABLE BREECH LOCK

(75) Inventors: Gerd Spinner, Oberndorf (DE); Helmut Weldle, Oberndorf (DE)

(73) Assignee: Heckler & Koch, GmbH, Oberndorf/Necker (DE)

( * ) Notice: Subject to any disclaimer, the term of this patent is extended or adjusted under 35 U.S.C. 154(b) by 0 days.

(21) Appl. No.: 10/226,891

(22) Filed: Aug. 23, 2002

(65) Prior Publication Data

US 2004/0035286 A1 Feb. 26, 2004

Related U.S. Application Data

(63) Continuation of application No. PCT/EP01/01629, filed on Feb. 14, 2001.

(30) Foreign Application Priority Data

Feb. 25, 2000 (DE) ..... 100 08 979
Feb. 1, 2001 (DE) ..... 201 01 770 U

(51) Int. Cl.[7] ..... F41A 3/00
(52) U.S. Cl. ..... 89/180; 42/70.01
(58) Field of Search ..... 89/125–199

(56) References Cited

U.S. PATENT DOCUMENTS

| | | | | |
|---|---|---|---|---|
| 1,533,967 A | | 4/1925 | Browning | |
| 1,533,968 A | | 4/1925 | Browning | |
| 2,664,786 A | | 1/1954 | Guisasola | 89/163 |
| 3,492,748 A | * | 2/1970 | Swenson | 42/70.01 |
| 3,745,881 A | * | 7/1973 | Roy | 89/163 |
| 3,756,120 A | * | 9/1973 | Roy | 89/163 |
| 3,780,618 A | * | 12/1973 | Sanford | 89/150 |
| 3,857,325 A | * | 12/1974 | Thomas | 89/138 |
| 4,176,584 A | * | 12/1979 | Thomas et al. | 89/138 |
| 4,358,987 A | * | 11/1982 | Wilhelm | 89/196 |
| 4,481,863 A | * | 11/1984 | Zanner et al. | 89/138 |
| 4,539,889 A | * | 9/1985 | Glock | 89/147 |
| 4,589,327 A | * | 5/1986 | Smith | 89/148 |
| 4,681,020 A | | 7/1987 | Polanecky | 89/138 |
| 4,726,136 A | | 2/1988 | Dornaus et al. | 42/70.08 |
| 4,742,634 A | * | 5/1988 | Swenson | 42/70.01 |
| 4,915,011 A | * | 4/1990 | Smith | 89/176 |
| 5,131,317 A | * | 7/1992 | Meller | 89/138 |
| 5,303,494 A | * | 4/1994 | Tuma et al. | 42/70.04 |
| 5,596,162 A | * | 1/1997 | Burns | 89/128 |
| 5,625,971 A | * | 5/1997 | Tuma et al. | 42/70.08 |
| 5,903,994 A | * | 5/1999 | Tange | 42/70.01 |
| 6,539,658 B1 | * | 4/2003 | Hubert et al. | 42/70.08 |

FOREIGN PATENT DOCUMENTS

| | | |
|---|---|---|
| CH | 47287 | 6/1910 |
| DE | 32 27 180 A1 | 1/1984 |
| DE | 34 35 809 A1 | 4/1985 |

OTHER PUBLICATIONS http://web.archive.org/web/200102031314000/http://khpro-.com/p2000.htm (Feb. 2001).*

Translation of an article from the periodical "Deutsches Waffenjournal," (i.e., 'German Weapons Journal') Jan. 2001, pp. 8–16.

*International Search Report* with English–language translation, corresponding to International Patent Application Serial No. PCT/EP01/01629, European Patent Office, Dated Jun. 26, 2001, 6 pages.

*International Preliminary Examination Report*, corresponding to International Patent Application Serial No. PCT/EP01/01629, European Patent Office, Dated Apr. 6, 2001, 8 pages.

English translation of international preliminary examination report for PCT/EP01/01629, mailed Feb. 20, 2003.

* cited by examiner

*Primary Examiner*—Michael J. Carone
*Assistant Examiner*—Troy Chambers
(74) *Attorney, Agent, or Firm*—Hanley, Flight & Zimmerman, LLC.

(57) ABSTRACT

Firearm(s) with a breech lock are disclosed. One such firearm includes a first pivoting lever which, when actuated, releases the breech lock and a second lever, which when actuated also releases the breech lock. The first and second levers are located on opposite sides of the weapon.

19 Claims, 2 Drawing Sheets

A - A

AUTOMATIC FIREARMS WITH A DETACHABLE BREECH LOCK

RELATED APPLICATION

This patent arises from a continuation application which claims priority under 35 U.S.C. § 120 from International Patent Application No. PCT/EP01/01629 filed Feb. 14, 2001.

FIELD OF THE DISCLOSURE

This disclosure relates generally to firearms and, more particularly, to automatic firearms with a detachable breech lock.

BACKGROUND

All positional designations used in this document, such as "forward", "top", etc., are referenced to a weapon located in the normal firing position, in which the barrel is pointing in the generally horizontal direction away from the shooter. "Forward" is in the direction of shooting (i.e., away from the shooter). The "longitudinal side" of the weapon is the lateral surface of the weapon, bounded by the upper and lower surfaces and extending from front to rear.

Repeating small arms are known from DE 34 35 809 and DE 32 27 180. A prior art weapon is also known from the periodical "Deutsches Waffenjournal" (i.e., 'German Weapons Journal'), January 2001, pages 8–16.

Breech locks of various types are provided in prior art repeating weapons and semi-automatic shooting weapons (semi-automatic weapons which are at firing readiness with the safety catch closed). The task of the breech lock of a multi-shot small arm such as, for example, an automatic pistol, is primarily to hold the safety catch open after the last shot in order to indicate to the shooter that no additional cartridges are present, and in order to shorten the subsequently following loading process.

In many cases, the mechanism that forms the breech lock is entirely accommodated within the interior of the weapon. Such is the case in the Walther pistols PP and PPK, for example. When the breech lock is so located, the shooter must, after the introduction of a loaded magazine or the like, grip the safety catch or the slide unit, draw it back slightly, and then let it loose. This operation takes place faster than normal reloading, which requires the complete removal of the safety catch over its entire range of reverse motion against the action of a closing spring.

If, when the weapon is unloaded, the safety catch held by the breech lock must be allowed forward, the magazine is first removed, and then the same activities as described above are to be carried out. If the safety catch is located in its forward position, then the magazine can be inserted again.

It is a safety feature that the safety catch of the unloaded pistol can only be closed when the magazine has been removed. The danger that an overlooked bullet located in the magazine will be loaded into the barrel is thereby avoided. The safety catch could, to be sure, be allowed forward without removing the magazine first, but since, in that case, the shooter would, in his view, have an empty magazine in the weapon, he will remove it from the weapon before closing the safety catch. Since accidents occur with inadvertently loaded weapons every year, this safety feature is of primary significance in cases where a shooter, upon carrying out maintenance on his weapon, may have ammunition within his grasp.

This danger is less in the case of military weapons since, at least during peacetime, the soldier has no ammunition available when cleaning the weapon.

Another, very widespread breech lock mechanism has a lever which is applied externally against the weapon and can be swiveled around a transverse axis. On the one hand, the lever engages with its end in the path of motion of the magazine feed mechanism and, on the other hand, in the path of motion of the safety catch, where it can drop down into a recess of the safety catch if this is opened and the magazine is empty. A handle is placed on the swivelable lever.

If, in such a weapon, a full magazine is introduced into a weapon in which the safety catch is held by the breech lock close to the position furthest to the rear, then it is sufficient to swivel the pivoting lever by applying pressure to its handle, so that it releases the safety catch and the safety catch moves forward. The loading process does not require the use of the second hand of the shooter in order to make the weapon ready to shoot again.

Even with the magazine empty, it is possible to press on the handle (against the fairly weak effect of the magazine spring) and to allow the safety catch to move forward without having removed the magazine. The behavior of the weapon is substantially the same, independent of whether the magazine is present or not.

The last-described breech lock is particularly common in Colt-Browning constructions (Colt M 1911, FN High Performance Browning, etc.) which are, at the present time, distributed in many modifications.

The Colt-Browning construction has a pivoting lever that is supported and positioned similarly to the lever (5) discussed below. The swiveling shaft of the Colt-Browning lever can serve at times as an anchoring unit for a locking element and must be removed for the disassembly of the weapon before the safety catch can be dismounted. As a rule, the closing spring serves as a catching spring for the attachment of the transverse shaft, although other solutions are also known, such as attachment by means of a steel clamp which resembles a bicycle chain lock, for example (Tokarew T. T., 1930 and 1933).

The sports shooter who only uses his weapon at the shooting stand has enough time for reloading. The breech lock of automatic sports pistols can thus, for reasons of safety, generally slide the safety catch forward again when the empty magazine is removed.

If automatic pistols are carried along by civilians or kept at hand for self-defense, only a single magazine is generally used. If this magazine is used until empty, then the shooter cannot reload any longer, because no additional magazine is available. In modem automatic pistols, moreover, the magazine capacity is increased considerably, insofar as legally permitted, so that a modern automatic pistol can load nearly a double quantity of bullets in comparison with an older pistol. The use of plastic in the construction of modern pistols compensates for the added weight of the larger quantity of bullets.

In a moderm automatic pistol for civilian use, the possibility of a rapid reloading by applying pressure to the pivoting lever of the breech lock is now, on the whole, less necessary than ever before.

In addition, it is ever more common, in the case of civilian small arms, to design them for the use of both right-handed and left-handed shooters. Operating levers, such as a safety lever or a handle for detaching the magazine mounting device are, thus, frequently attached to both sides of the weapon.

Such solutions are also offered in military weapons but often remain unused there, however, because it is simpler to accustom a left-handed shooter to operating the weapon with his right hand than it is to carry out the training of right-handed and left-handed shooters, who use the other hand for the same operating processes, at the same time. The uniformity of movement of all soldiers, which is a decisive criterion for the trainer, is thus lost. Moreover, there are many small arms which, depending on the construction type, are designed either exclusively for right-handed shooters or exclusively for left-handed shooters. Such weapons cannot be used correctly by a person for whom they are not designed, and can even lead to injuries.

For the above reasons, in small arms, particularly those for military use and, most particularly, in automatic pistols of the Colt-Browning or a similar type, the handle for the breech lock is only attached to one side of the weapon, so that it can only be operated with the right hand of the shooter. This Colt-Browning construction has been known and extremely widespread for almost 90 years.

DESCRIPTION OF THE PREFERRED EXAMPLES

Figures 1, 2, 3, 4, 5:
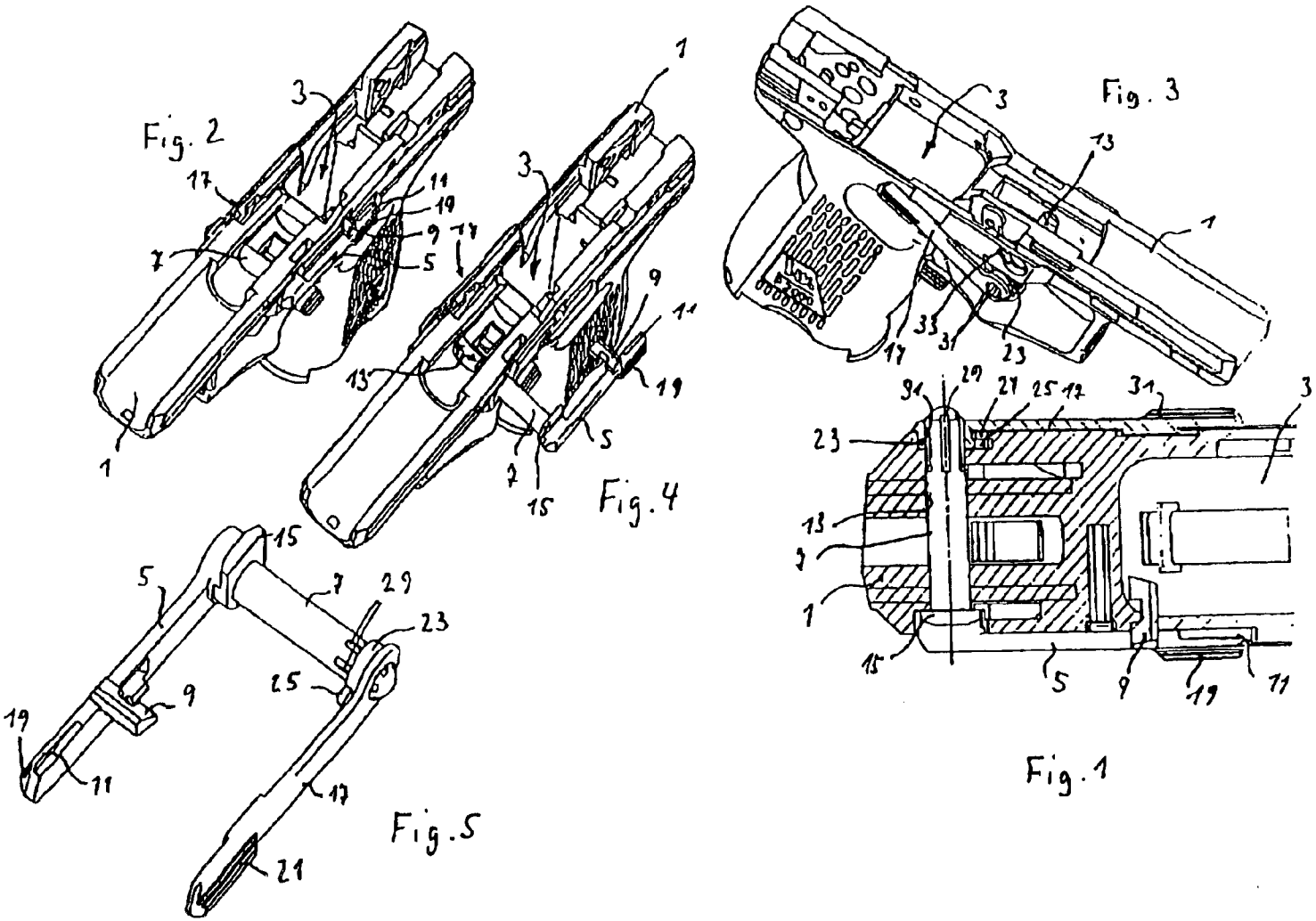
FIG. 1 is a cross-sectional view through a portion of an example pistol stock, taken in a horizontal direction, with the pivoting levers mounted.
FIG. 2 is a top perspective view of an example pistol stock for the pistol of FIG. 1, again with the pivoting levers mounted.
FIG. 3 is a view similar to FIG. 2, but from another angle of viewing, upon the installation of the second pivoting lever.
FIG. 4 is a view similar to FIG. 2, upon the installation of the first pivoting lever.
FIG. 5 is an enlarged view of both example dismounted, but assembled, pivoting levers.

FIG. 1 depicts a horizontal cross-section through a portion of a pistol stock (1) of an example automatic pistol. The direction of shooting points to the left.

FIG. 1 and FIG. 5 have approximately the same scale, while the overall depictions of the pistol stock (1) of FIGS. 2, 3, and 4 have a scale that is reduced relative to FIGS. 1 and 5. "Forward," or the direction of shooting, is directed towards the lower left in FIGS. 2 and 4, to the lower right in FIG. 3, and towards the upper right in FIG. 5.

The pistol stock (1) encompasses a magazine shaft (3). A horizontal cross-boring (13) is positioned in front of the magazine shaft (3). A swiveling shaft (7) has a first pivoting lever (5) solidly bolted to its left end and is seated in a rotatable manner within the cross-boring (13). This pivoting lever (5) extends roughly horizontally in the longitudinal direction of the pistol stock (1). The lever (5) is located adjacent the outside left of the stock (1). The forward end of the pivoting lever (5) is riveted to the swiveling shaft (7).

The pivoting lever (5) has, proceeding from its forward end after approximately two thirds of its length, a probing finger (9) oriented towards the pistol stock (1). The probing finger extends through an opening in the pistol stock (1) and projects into the magazine shaft (3) for a slight distance. When the magazine is inserted, the probing finger (9) allows the bullets to slide past until, upon removal of the last bullet from the magazine, it is engaged by the magazine feeding unit and thereby stressed towards the top of the weapon. For the sake of simplicity, the magazine, along with its feeding unit, is omitted in the diagram. If the last shot is now fired, then the safety catch or the slide unit (not depicted) moves towards the rear.

A catch part (11) which extends upwardly is configured on the upper side of the pivoting lever (5) near the rear end of the same. When the safety catch is closed, it fits closely against this catch part (11) from below. The safety catch has, on its lower side, a recess into which the catch part (11) can then drop down if the safety catch is located in its rear position and if the probing finger (9) is lifted up by the feeding unit of the magazine.

If the safety catch, after the last shot, carries out its reverse motion movement and reaches the rear end, then the pivoting lever (5) swivels upwardly around the middle axis of the swiveling shaft (7), because the probing finger (9), and thereby the catch part (11) as well, are lifted up by the feed unit of the magazine. If the safety catch now moves forward toward its closed position, after leaving its most rearward position the safety catch runs up onto the probing finger (9) where it remains.

A first handle (19) is located on the outer side of the pivoting lever (5), near the rear end of the same. If this handle (19) is pressed downwardly, with the safety catch held back by the catch part (11), then the catch part (11) is also moved downwardly, thereby releasing the safety catch, which, consequently, pushes forward.

A holding part (15) jutting upwardly is positioned near the junction of the swiveling shaft (7) with the pivoting lever (5). If the safety catch is slid forward onto the pistol stock (1), then the holding part (15) is encompassed by the safety catch in such a manner that its outer edge is located on the outer side of the holding part (15) and under its upper edge. Thus, the holding part (15) cannot move outwardly. If, on the other hand, the safety catch is removed from the pistol stock (1), then the swiveling shaft (7) can be removed from the boring (13) via the pivoting lever (5). A catching unit which acts on the swiveling shaft (7) is not necessary and is also not provided.

The apparatus depicted above generally corresponds to a known breech lock. The first pivoting lever (5) can be used alone and without further addition.

The free end of the swiveling shaft (7) has a multiple-groove profile (29). The grooves of this profile are positioned in parallel to one another at the same angular distance, and extend up to the free end of the shaft (7). A stud (23) with a boring which has a complementary profile (31) is slid up onto this multiple-groove profile (29). This stud (23) forms a part of a second pivoting lever (17). The second lever (17) extends from this stud (23) to the rear, where a second handle (21) is formed. As is evident from FIG. 5, the first and the second pivoting levers (5, 17) are externally configured nearly equally, and extend in parallel to one another. Each lever (5, 17) also supports its corresponding handle (19, 21) at points lying opposite to one another. Thus, the second handle (21) of the second pivoting lever (17) is positioned for use by the activating thumb of the left hand of a left-handed shooter and lies at substantially the same, but opposite, point as the handle (19) of the first pivoting lever (5) which is located for use by the right thumb of a right-hand shooter.

A projection (25) is formed on the radial external side of the stud (23). A recess (33) of the part of the mounting boring (13) corresponds to this projection (25). The mounting boring accommodates the stud (23). The projection (25) and recess (33) are positioned in such a manner that they are positioned opposite one another if the second pivoting lever (17) occupies an angular position other than the normal firing position. This angular position of installation is depicted in FIG. 3.

After the insertion of the stud (23) with its projection (25) into the recess (33) of the mounting boring (13), the second pivoting lever (17) is swiveled, so that the projection (25) enters into a recess in the wall of the pistol stock (1), which thereby forms a counter-projection (27) (FIG. 1), which is engaged by the breech lock (25). The second pivoting lever (17) is, thus, prevented from detaching. The second pivoting lever (17) is consequently attached to the right side wall of the pistol stock (1) by means of a bayonet catch.

The installation of both the pivoting levers (5, 17) takes place as follows:

First, the second pivoting lever (17) is, by means of the bayonet catch described above, inserted into the pistol stock (1) in a specific rotational position, as is depicted in FIG. 3. The second pivoting lever (17) can only occupy this rotational position if the safety catch is removed. The second pivoting lever (17) is then swiveled into its position of use. The first pivoting lever (5) is now inserted, along with the swiveling shaft (7), into the mounting boring (13) (depicted in FIG. 4). The probing finger (9) thereby penetrates into the opening assigned to it in the left wall of the pistol stock (1). At the same time, the multiple-groove profile (29) penetrates into the complementary profile (31) (shown in FIG. 3). Since the swiveling movement of the second pivoting lever (17) is now limited by the travel distance that is available to the probing finger (9) in the assigned opening, the second pivoting lever (17) cannot detach from the pistol stock and stands in non-rotating connection with the first pivoting lever (5). Therefore, pressing down the second handle (21) results in the same motion as pressing down the first handle (19) by a like amount. By virtue of such pressing, the first pivoting lever (5) is swiveled and the catch part (11) is thereby lowered. The pistol stock is shown in FIG. 2 with the pivoting levers (4, 17) installed.

Placing of the safety catch or slide unit onto the pistol stock (1) prevents the first pivoting lever (5) from detaching, because one edge of this safety catch overlaps with the holding part (15) on its outer side.

Dismounting the levers (5, 17) takes place in the reverse sequence.

The illustrated breech lock requires only one single, additional part to the already-known first pivoting lever (5), namely, the second pivoting lever (17). This second pivoting lever (17) is preferably a cast part which can be produced in a relatively economical manner. The complementary profile (31) of the stud (23) is roughly formed in the casting process, and only needs to be additionally finished with a machining tool.

Figure 6:
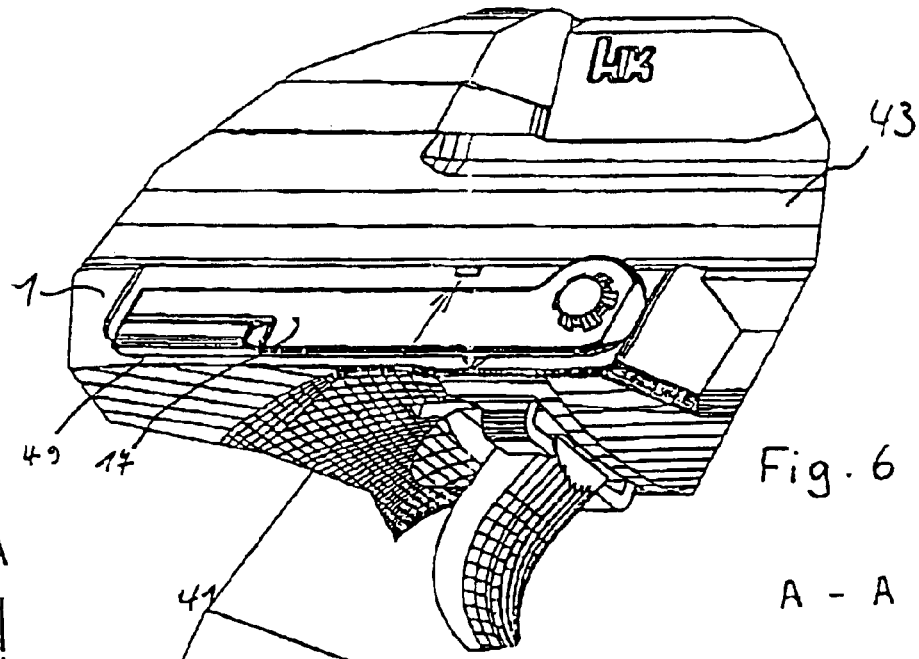
FIG. 6 is an enlarged, partial perspective view of an example automatic pistol shown from the front, bottom, and right.

FIG. 6 depicts a portion of an example automatic pistol including: a pistol stock (1) of reinforced plastic, a slide unit (43) attached to the pistol stock in such a manner that it can be moved back and forth and can be removed, a second pivoting lever (17), and a trigger (no reference numeral). The slide unit (43) proceeds roughly horizontally, the handle (only the upper part of which is indicated) extends downwardly, and the direction of shooting proceeds to the right in FIG. 6. The second pivoting lever (17), in the resting position depicted, extends in parallel to the slide unit (43), is attached with its forward end to a shaft (7) which connects it rigidly with the non-visible safety catch catching lever (5) positioned on the right side of the weapon, and has a handle on its rear end.

If the magazine (not depicted) of the weapon is empty and the safety catch moves back, then the safety catch catching lever (5) is pressed upwardly by the feeding unit of the magazine, engages with the slide unit (43), and holds this in its rear position. In this position, the second pivoting lever (17) is swiveled upwardly around the shaft (7) to a slight degree, so that its rear end (which supports the handle) is placed closely below the slide unit (43). A left-handed shooter holding the weapon with the left hand can now press on the handle of the second pivoting lever (17) to swivel the lever (17) downward. This movement also swivels the first pivoting lever (5) downward and, thus, releases the slide unit (43) for forward movement.

Figure 7:
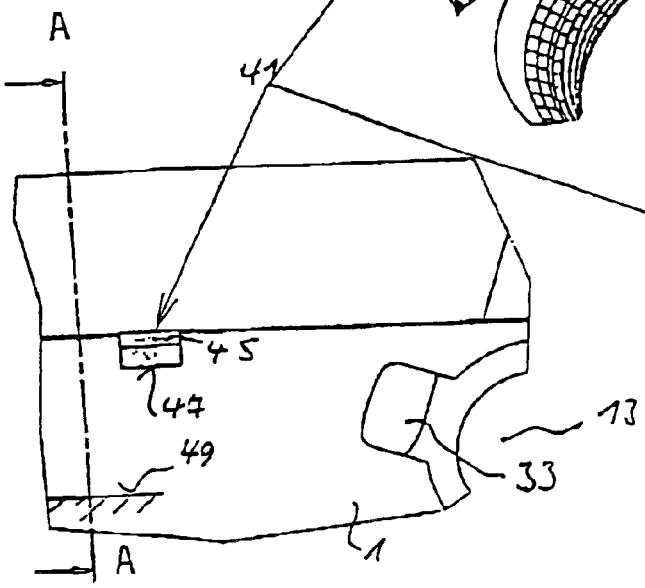
FIG. 7 is an enlarged partial lateral view of the pistol of FIG. 6, viewed from the right.

The second pivoting lever (17) is omitted in FIG. 7 to render visible an example mounting boring (13) and a recess (33) in communication with this boring (13). The recess (33) and boring (13) together form a part of a bayonet-type holding device for the second pivoting lever (17).

Figure 8:
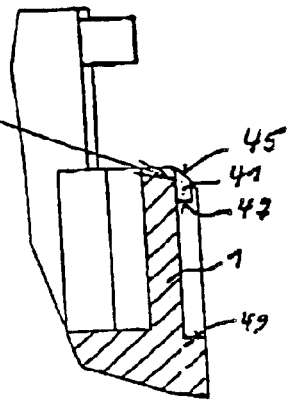
FIG. 8 is a sectional view taken along the line A—A in FIG. 7.

Behind and above the recess (33), a projection (41) is formed on the outer side of the pistol stock (1). This projection (41) is seated on one free upper edge of the pistol stock (1) and—when the pistol is assembled—consequently adjoins the lower edge of the slide unit (43). As FIG. 8 shows, the thickness of the wall of the pistol stock (1) is particularly slight at this point.

The projection (41) is formed as a flat, horizontal square, the upper side of which, however, is sloped (slope (45)). This slope (45) proceeds downward from the upper edge of the pistol stock (1). On the lower side, the projection (41) forms a substantially horizontal transverse edge (47), which is oriented towards the second pivoting lever (17).

Before the slide unit (43) is placed onto the pistol stock (1), the second pivoting lever (17) is mounted. To this end, the second pivoting lever (17) is inserted with its bayonet catch parts into the mounting boring (13) and the recess (33). Once so inserted, the lever (17) is swiveled in a counter-clockwise direction (if, as in FIG. 2, the right-hand side of the weapon is considered). The second pivoting lever (17) thereby moves, from the top, against the slope (45) and then presses the projection (41), and thereby the right-hand side wall of the pistol stock, inwardly to a slight extent until it moves downwardly over the transverse edge (47). When the second pivoting lever (17) has passed the transverse edge (47), then the projection (41) snaps outwardly again. The transverse edge (47) thereby lies next to the upper edge of the pivoting lever (17) and thereby prevents the lever (17) from being able to swivel upwardly over the projection (41) again.

If the slide unit (43) is now placed on the stock (1), then the second pivoting lever (17) can swivel inside its area of operation/movement. This area is limited by the slide unit (43), on which the rear end of the lever (17) catches from below. In the illustrated example, the second pivoting lever (17) does not, however, impact against the projection (41). The projection (41) consequently does not disturb the operation of the second pivoting lever (17) and is also not damaged by the impact of the pivoting lever (17).

Upon normal disassembly of the weapon for the purpose of cleaning and care, the second pivoting lever (17) remains in its place, because it is prevented by the projection (41) from detaching from the pistol stock (1). If it is to be disassembled, however, then it is sufficient to vigorously press the projection (41) to the interior and to then swivel the pivoting lever (17) over the projection (41) and into that position in which the bayonet catch detaches.

A ledge (49) is preferably formed below the second pivoting lever (17). This limits the swiveling movement of the second pivoting lever (17) in a downward direction in such a manner that, in the resting position, it is nearly seated on the ledge (49). The ledge (49), just like the projection (41), does not impede the swiveling movement of the second pivoting lever (17) upon the normal use of the weapon, but instead forms a catching stud for the second pivoting lever (17) if it is not connected with the first pivoting lever (5).

That is to say, the second pivoting lever (17) remains on the weapon after the normal disassembly of the weapon. The first pivoting lever (5) would have to be removed, however, since a disassembly would not otherwise be possible.

If the weapon is assembled again, then the first pivoting lever (5) is pushed from the left with its shaft (7) into the pistol stock (1). The non-circular cross-section of the free end of the shaft (7) should now be inserted into the mount in the second pivoting lever (17). In order for this insertion to be carried out quickly and easily, the pivoting lever (17) is seated adjacent the ledge (49). The first and the second pivoting lever (17) now both occupy a corresponding position. Thus, the shaft (7) of the first pivoting lever (5) can be inserted quickly, effortlessly, and correctly into the mount in the second pivoting lever (17).

Persons of ordinary skill in the art will appreciate that, although the teachings of the invention have been explained in connection with an example type of weapon, they can also be applied to weapons with other principles of construction, such as long guns or the like. The automatic pistol illustrated herein, however, represents one particularly advantageous example.

From the foregoing, persons of ordinary skill in the art will appreciate that a firearm having a breech lock that can be detached by means of a handle has been disclosed. The illustrated firearm has a second handle (17) connected to the first handle (5), and positioned on the opposite longitudinal side of the weapon from the first handle (5). As a result, the breech lock can be activated by a left-handed shooter by means of a handle (21), in the same manner as was previously only possible for a right-hander. It is also possible, however, to insert or to detach the breech lock from each side of the weapon when eliminating loading jams or during repair works, so that the operating possibilities of the weapon are generally expanded and the weapon is consequently improved overall, and not simply for left-handers.

The addition of the second lever (17) can be carried out without great modifications of available weapons, and is economical. Moreover, the second lever (17) can be either used or omitted in an optional manner.

The breech lock can have a slide unit which engages with the magazine feeding unit from the rear and supports, on the side, the first handle (19), which extends to the outside, through a first slot in the weapon casing or pistol stock (1). In the illustrated example, the second handle (21) extends outwardly through a second slot which is positioned opposite to the first slot, on the other side of the slide unit, inside the casing or pistol stock (1).

In the illustrated example, it is advantageous that the first handle (19) is seated on a first pivoting lever (5) that can be swiveled around a transverse axis proceeding transversely to the longitudinal axis of the weapon. On the other side of the weapon, a second pivoting lever (17), which can be swiveled around the same transverse axis, is seated on the second handle (21). Both pivoting levers (5, 17) are connected with one another in a non-rotating manner by means of a swiveling shaft (7), which extends coaxially to the transverse axis. The pivoting levers (5, 17) can be positioned inside the walls of the casing or pistol stock (1), but preferably lie outside these walls, since the entire thickness of the wall of the casing or pistol stock (1) can, in that case, be used to support the swiveling shaft (7). Also, no grooves, which have to extend along the path of motion of the handle, then penetrate the wall of the casing or pistol stock (1) to thereby weaken this wall.

In the illustrated example, the pivoting lever (5) or its swiveling shaft (7) is not used for the disassembly of the weapon. The first pivoting lever (5) is, to be sure, solidly connected with the swiveling shaft (7), such as firmly riveted to it, for example. The pivoting lever (5), however, has a projection (15) extending upwardly which, after the assembly of the weapon, is encompassed by another component with clearance in such a manner that the swiveling movement of the pivoting lever (5) is not impeded, although the swiveling shaft (7) cannot be removed from its mounting boring (13) in the casing or pistol stock (1). This component is, preferably, a longitudinal edge on the safety catch extending downwardly. If the safety catch is removed, then the pivoting lever (5) and the swiveling shaft (7) can then be easily removed.

This holding projection (15) can be positioned at any point of the pivoting lever (5), but is preferably positioned close to the junction of the swiveling shaft (7), since the swiveling movements of the pivoting lever (5) require the smallest distances there.

The second pivoting lever (17) can be permanently attached to the free end of the swiveling shaft (7) since, as mentioned above, the dismounting of the pivoting lever (17) is not necessary for the disassembly of the weapon. However, the second pivoting lever (17) is, in contrast to the first pivoting lever (5), preferably attached to the swiveling shaft (7) in a detachable manner. It is thereby possible to form the free end of the swiveling shaft (7) in a non-circular manner, such as quadrilateral, in order to insert it into a complementary boring in the second pivoting lever (17) and to hold this tightly from the outside, via a screw screwed into the swiveling shaft (7). The second pivoting lever (17) is thereby also held tightly. Upon disassembly or shooting, however, the danger exists that the small screw will be lost, or that the threading in the swiveling shaft (7) will be damaged.

Therefore, the securement of the second pivoting lever (17) is preferably achieved through attachment of the second pivoting lever (17) to the casing or pistol stock (1) of the weapon by a bayonet catch. A bayonet catch permits a rectilinear movement of the second pivoting lever (17) along the transverse axis, which is also the middle axis of the transverse shaft (7), and then a rotary movement. During the rectilinear movement, a projection (25) on the second pivoting lever (17) is guided through a bulge (33) of the mounting boring (13) for the transverse shaft (7). After the rotational movement, the stated projection (25) engages a part of the casing or the pistol stock (1). As a result, the second pivoting lever (17) is held on the side of the casing or pistol stock (1) in a swivelable and reliable manner, as long as it does not move into a swiveling position in which the projection (45) again aligns with the recess (33). The transverse shaft (7) penetrates at least a portion of the second pivoting lever (17) with a non-circular section. The mounting boring in the second pivoting lever is thereby configured in a manner complementary to the non-circular section, so that the second pivoting lever (17) follows any swiveling movement of the transverse shaft (7) practically free of clearance.

The second pivoting lever (17) is not, therefore, permanently attached to the end of the transverse axis (7), but is, rather, only removably connected thereto in a non-rotating manner. The bayonet catch, which permits a limited rotation of the pivoting lever (17), but not its detachment from the wall of the casing or pistol stock (1), ensures the axial attachment of the pivoting lever (17) to the axis (7) by preventing the lever (17) from sliding off of the shaft (7).

It is unimportant which side of the weapon on which the first or the second pivoting lever (5, 17) lies. It is possible to form the second pivoting lever (17) or both pivoting levers (5, 17) with a probing finger unit which cooperates with the feeding unit of the magazine. In the last-stated case, the connection of the two pivoting levers (5, 17) does not need to be non-rotating.

The non-circular section of the transverse shaft (7) can be a square, for example. The end of the transverse shaft (7), however, is preferably provided with longitudinal grooves, which are distributed uniformly over the circumference and proceed up to the end of the transverse shaft. Together with the complementary boring in the pivoting lever (17), a so-called multiple-groove profile connection, which is suitable for the transmission of a high torque, is consequently produced.

The illustrated breech lock can be used in repeating firearms of all types (e.g., it is preferably used in semi-automatic weapons and, particularly preferably, in automatic pistols). In the illustrated example, an external pivoting lever (17) on one side is coupled to a conventional pivoting lever (5) positioned externally on an opposite side of the pistol stock (1). In the illustrated example, there is no engagement between the illustrated lever (17) and the interior mechanism of the automatic pistol. The illustrated second pivoting lever (17) does not require any accommodation space inside the interior of the pistol stock (1) of the pistol.

If a customer does not want the second pivoting lever (17), then this can be easily dismounted and left out without any resulting losses in the secure function of the weapon.

In known automatic pistols constructed in accordance with the Colt-Browning system, such as the High Performance Browning, for example, the sole left-hand pivoting lever present (i.e., the first pivoting lever) must, during the disassembly of the weapon, first of all be removed before the safety catch or slide unit can be removed forward with the barrel. For that, the safety catch or slide unit can first be brought into a special position. The sole pivoting lever is then swiveled into a recess to the left, in the lower side of the safety catch or slide unit. The sole pivoting lever can now be removed to the left, out of the pistol stock.

In the weapon disclosed herein disassembly can proceed in precisely this manner. The removal of the shaft (7) from the second pivoting lever (17) does not require any additional handle, but instead takes place if the shaft (7) is simply removed from the pistol stock (1).

In the weapon illustrated herein, the second pivoting lever (17) can remain on the pistol stock (1). Since it is not permanently attached to the casing (1), however, the lever (17) can fall out upon handling the casing (1) without being noticed were it not otherwise secured by the bayonet catch. Because the assembly of the weapon is also possible without a second pivoting lever (17), this dropping out can even remain unnoticed upon and after assembly.

It would be possible to prevent this disadvantage by attaching the second pivoting lever (17) in a way other than by means of the bayonet catch attachment, such as by an internal flange screwed on to the second pivoting lever (17), for example. Expensive additional precision parts would be necessary for this, however, which would not only make the weapon expensive, but would also reduce it in its reliability.

To prevent the second pivoting lever (17) from becoming lost when the weapon is disassembled, even upon inattentiveness on the part of the user, the illustrated firearm has a catching unit, which limits the swiveling path of the second pivoting lever (17) to an area that lies outside the swiveling position which is necessary for the installation and disassembly of the second pivoting lever (17). In other words, the catching unit permits the free swiveling movement of the second pivoting lever (17) only within its area of operation to ensure the angular position of the second pivoting lever (17) which is necessary for installation and disassembly, has still not yet been reached.

The catching unit can lie precisely at the boundary of the area of operation and consequently limit this area. It is, thus, not necessary to limit it with other means, such as by the safety catch or slide unit, for example. The catching unit can be formed by a pin, for example, which is moved in or screwed into the casing or pistol stock from the outside, and is prevented from falling out by the safety catch or slide unit. This pin or screw, as the case may be, engages in the bayonet catch, for example, and limits its range of swiveling.

The fact that the pin or catching unit must be sturdy enough to resist the stresses to which it is exposed during operation upon limiting the area of operation/movement is disadvantageous, however. Therefore, it is preferred that the catching unit be attached in such a manner that it is not active inside the area of operation/movement of the lever (17), but instead is only active outside this area, and is, thus, not exposed to any types of stresses during normal operation. The catching unit must naturally be attached in such a manner, however, that the second pivoting lever (17), when the catching unit is active, cannot reach the angular position which permits dismounting of the lever (17).

The catching unit can be configured as an internal peg which, for example, engages with the bayonet catch of the second pivoting lever (17). The forces thereby appearing are quite high, however, so that abrasion phenomena can come about. It is therefore preferred that the catching unit be configured as a peg (41) which is positioned externally on the pistol stock (1), opposite to the second pivoting lever (17).

The free end of the second pivoting lever (17) impacts against the safety catch or slide unit if the pivoting lever (17) is swiveled when the weapon is assembled. The second pivoting lever (17) preferably does not, however, thereby impact against the peg (41). That is to say, the peg (41) is located at a point a little bit above the second pivoting lever (17) and very close below the lower edge of the safety catch or slide unit, and cannot, therefore, be reached by the second pivoting lever (17) when the weapon is assembled.

The peg can be soldered or glued onto the pistol stock (1) after the second pivoting lever (17) has been mounted. This has the disadvantage, in any event, that this peg must be removed for dismounting, which is expensive. In order to remedy this defect, for example, the peg is preferably configured as a fixed projection (41), which can only be removed by means of its destruction. This projection (41) is sloped on the upper side, so that the pivoting lever (17), upon being mounted, can first be attached with a slight clearance and/or deformed by the bayonet catch in a flexible manner. The shaft (7) of the first pivoting lever (5) then centers the second pivoting lever (17) and prevents deformation. In addition, the edge (47) of the projection (41) that is oriented toward the pivoting lever (17) in its operating position is preferably configured perpendicularly to its swiveling path so that, when the weapon is disassembled, it cannot move over the projection (41), or cannot move at all.

Narrow tolerances are now necessary for this, however, since the pivoting lever (17) must only move or deform to the extent that is necessary. Thus, it is preferred that the projection (41) be formed on a pistol stock or casing (1) manufactured primarily from plastic, which is not as rigid as a metal casing. Furthermore, the projection (41) is preferably positioned on the upper edge of the casing or pistol stock (1), where this can more easily move to the internal side of the casing.

The projection (41) is, preferably, positioned at a point at which the casing or pistol stock (1) permits a slight deformation transversely to the direction of shooting and in the horizontal direction.

The path of operation/movement of the second pivoting lever (17) is limited by a catching stud (49) at the bottom, and, thus, opposite to the preferred lower side (47) of the projection (41). If the weapon is disassembled, then the first pivoting lever (5) is removed and the second pivoting lever (17) remains in place. Upon renewed assembly, the second pivoting lever (17) can be pressed against the catching stud (49) and thereby occupy a position in which the shaft (7) of the first pivoting lever (5) can be quickly, easily, and precisely inserted into the mounting unit in the second pivoting lever (17). Thus, assembly is significantly simplified.

Upon assembly, the second pivoting lever (17) is first—with the safety catch or slide unit removed—inserted into the pistol stock (1), and then vigorously swiveled into its position of use. It thereby proceeds up against the sloped projection (45) and presses this, with slight deformation of the plastic pistol stock (1), toward the interior. After the second pivoting lever (17) passes, the projection (41) snaps outwardly again. Therefore, the pivoting lever (17) cannot be lost when the weapon is disassembled. The pivoting lever (17) thereby also naturally moves to a slight extent, within the framework of its tolerances. If the second pivoting lever (17) is supposed to be disassembled for any reason, then the upper walls of the pistol stock (l) are pressed together slightly and the pivoting lever (17) is pressed outwardly, if necessary, and then guided over the projection (41). No additional part is thereby necessary.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A firearm having a breech lock, the firearm comprising:

a housing;

a first pivoting lever to activate the breech lock, the first pivoting lever being positioned on a first side of the housing;

a swiveling shaft positioned transversely to the housing and rigidly connected to the first pivoting lever, the swiveling shaft having an end with a non-circular cross-section; and a second pivoting lever to activate the breach lock, the second pivoting lever being positioned on a second side of the housing opposite the first side of the housing, the second pivoting lever having a boring to detachably receive the end of the swiveling shaft, wherein the second pivoting lever is attached to the housing via a bayonet catch, and, to release the second pivoting lever from the bayonet catch, the second pivoting lever must be pivoted to an angular position which the second pivoting lever does not reach to activate the breech lock.

2. A firearm as defined in claim 1 wherein the first pivoting lever includes a first handle.

3. A firearm as defined in claim 2 wherein the second pivoting lever includes a second handle to facilitate movement of the second pivoting lever to deactivate the breech lock.

4. A firearm as defined in claim 1, wherein the end of the swiveling shaft comprises a cylindrical section including longitudinal grooves.

5. A firearm as defined in claim 1, wherein the breech lock can be actuated by moving at least one of the first pivoting lever and the second pivoting lever through a predefined angle.

6. A firearm as defined in claim 1 wherein at least one of the first and second pivoting levers includes a probing finger positioned within the housing to cause upward movement of the first and second pivoting levers when a magazine associated with the firearm is empty to thereby automatically activate the breech lock.

7. A firearm having a housing and a breech lock, the firearm comprising:

a first pivoting lever to activate the breech lock, the first pivoting lever being positioned on a first side of the housing;

a swiveling shaft positioned transversely to the housing and rigidly connected to the first pivoting lever;

a second pivoting lever positioned on a second side of the housing opposite the first side of the housing, the second pivoting lever being removably attached to the swiveling shaft of the first pivoting lever such that the second pivoting lever cannot be rotated relative to the swiveling shaft, and the second pivoting lever being removably attached to the housing such that the second pivoting lever is removable from the housing if the second pivoting lever is pivoted to a release position; and a catching unit associated with the housing to limit movement of the second pivoting lever to an area excluding the release position.

8. A firearm as defined in claim 7, wherein the catching unit lies outside a normal operation movement path of the second swiveling lever.

9. A firearm as defined in claim 7, wherein the catching unit comprises a peg located external to the housing and above the second pivoting lever.

10. A firearm as defined in claim 9, wherein the peg comprises a projection having a camming surface to facilitate installation of the second pivoting lever, and a blocking surface to limit movement of the second pivoting lever after installation.

11. A firearm as defined in claim 7, wherein the housing is formed from plastic.

12. A firearm as defined in claim 10, wherein the projection is located at a point near an upper edge of the housing where the housing is flexibly deformable in a direction transverse to the direction of shooting.

13. A firearm as defined in claim 9, wherein a catching ridge is located on an outer surface of the housing opposite to the peg to provide a lower limit on pivoting movement of the second swiveling lever.

14. A firearm as defined in claim 7 wherein at least one of the first and second pivoting levers includes a probing finger positioned within the housing to cause upward movement of the first and second pivoting levers when a magazine associated with the firearm is empty to thereby automatically activate the breech lock.

15. For use with a firearm, an assembly comprising:

a housing;

a first pivoting lever to activate a breech lock;

a second pivoting lever to activate the breech lock; and a shaft having an axis, a first end connected to the first pivoting lever and a second end connected to the second pivoting lever, the second pivoting lever being connected to the second end such that the second pivoting lever cannot rotate relative to the shaft but the shaft can be moved along the axis to remove the shaft from the second pivoting lever, the second pivoting lever being connected to the housing such that the second pivoting lever cannot be moved along the axis unless the second pivoting lever is pivoted to a release position wherein the second pivoting lever is released from the housing.

16. An assembly as defined in claim 15 wherein the first pivoting lever is permanently secured to the shaft.

17. An assembly as defined in claim 16 wherein removing the first pivoting lever and the shaft from the housing does not release the second pivoting lever from the housing.

18. A firearm as defined in claim 15 wherein at least one of the first and second pivoting levers includes a probing finger positioned within the housing to cause upward movement of the first and second pivoting levers when a magazine associated with the firearm is empty to thereby automatically activate the breech lock.

19. A firearm comprising:

a housing having a grip;

a first pivoting lever positioned on a first side of the housing for deactivation of a breech lock with a first thumb of a first hand gripping the grip;

a second pivoting lever positioned on a second side of the housing for deactivation of the breech lock with a second thumb of a second hand gripping the grip, the first and second levers being operatively connected such that, pivoting one of the first and second levers pivots the other of the first and second levers, wherein when the first lever is removed from the housing to permit removal of the breech lock, the second lever remains attached to the housing unless the second lever is intentionally removed; and at least one catch located on an upper surface of at least one of the first and second levers.

* * * * *